US009458655B2

(12) United States Patent
deNormand

(10) Patent No.: US 9,458,655 B2
(45) Date of Patent: Oct. 4, 2016

(54) CONSTANT FORCE MOVING COIL WINDOW BALANCE WITH DROP-IN CARRIER

(71) Applicant: Caldwell Manufacturing Company North America, LLC, Rochester, NY (US)

(72) Inventor: Richard S. deNormand, Victor, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 0 days.

(21) Appl. No.: 14/939,133

(22) Filed: Nov. 12, 2015

(65) Prior Publication Data

US 2016/0138317 A1 May 19, 2016

Related U.S. Application Data

(60) Provisional application No. 62/080,542, filed on Nov. 17, 2014.

(51) Int. Cl.

| | |
|---|---|
| ***E05F 1/00*** | (2006.01) |
| ***E05D 15/22*** | (2006.01) |
| ***E05D 13/00*** | (2006.01) |
| ***E06B 3/50*** | (2006.01) |

(52) U.S. Cl.

CPC ..... *E05D 15/22* (2013.01); *E05D 13/1276* (2013.01); *E06B 3/5063* (2013.01)

(58) Field of Classification Search

CPC .. E05D 15/22; E05D 13/1276; E06B 3/5063

USPC ..... 49/445, 447; 16/197, 400, 401

See application file for complete search history.

(56) References Cited

U.S. PATENT DOCUMENTS

| | | | | |
|---|---|---|---|---|
| 5,353,548 | A | 10/1994 | Westfall | |
| 5,463,793 | A | 11/1995 | Westfall | |
| 5,661,927 | A * | 9/1997 | Polowinczak et al. | 49/447 |
| 6,860,066 | B2 * | 3/2005 | Kunz et al. | 49/181 |
| 6,990,710 | B2 * | 1/2006 | Kunz et al. | 16/193 |

(Continued)

FOREIGN PATENT DOCUMENTS

WO WO 2011/100280 8/2011

OTHER PUBLICATIONS

"Inverted Balance Constant Force" Amesbury [Brochure], Amesbury Window Hardware, Sep. 2010.

(Continued)

*Primary Examiner* — Jerry Redman

(74) *Attorney, Agent, or Firm* — Harness, Dickey & Pierce, P.L.C.

(57) ABSTRACT

The disclosure provides a window balance assembly for installation in a window assembly. The window balance assembly includes a carrier, a curl spring, and a mounting bracket. The spring element includes first and second portions. The first portion is contained by the carrier and the mounting bracket engages the second portion. The carrier has a first housing including a channel formed in an exterior side of the first housing and an aperture in which a receiver is included. The channel extends vertically upwardly from the aperture toward the top end of the first housing portion to facilitate a full-drop-in installation and removal of a window sash from the window assembly.

12 Claims, 11 Drawing Sheets

(56) References Cited

U.S. PATENT DOCUMENTS

| | | | | |
|---|---|---|---|---|
| 7,587,787 | B2 * | 9/2009 | Pettit | 16/197 |
| 7,735,191 | B2 | 6/2010 | Tuller | |
| 8,561,260 | B2 * | 10/2013 | Baker et al. | 16/193 |
| 8,819,896 | B2 * | 9/2014 | Kellum et al. | 16/193 |
| 8,850,745 | B2 * | 10/2014 | Sofianek et al. | 49/447 |
| RE45,328 | E * | 1/2015 | Tuller | 16/193 |
| 9,003,710 | B2 * | 4/2015 | Kellum et al. | 49/445 |
| 9,115,522 | B2 * | 8/2015 | Sofianek et al. | |
| 9,133,656 | B2 | 9/2015 | Steen et al. | |
| 2007/0101654 | A1 * | 5/2007 | Robertson | 49/445 |
| 2008/0178425 | A1 * | 7/2008 | Tuller | 16/197 |
| 2014/0259524 | A1 * | 9/2014 | Kellum et al. | 16/197 |

OTHER PUBLICATIONS

"Window Balance Hardware Constant Force", Amesbury Hardware Products Catalog, Sep. 2013.

* cited by examiner

CONSTANT FORCE MOVING COIL WINDOW BALANCE WITH DROP-IN CARRIER

CROSS-REFERENCE TO RELATED APPLICATION

This application claims the benefit of U.S. Provisional Application No. 62/080,542 filed on Nov. 17, 2014. The entire disclosure of the above application is incorporated herein by reference.

FIELD

The present disclosure relates to window balances and, more particularly, to a full drop-in, constant force, moving coil window balance including a carrier assembly, curl spring and mounting bracket.

BACKGROUND

This section provides background information related to the present disclosure which is not necessarily prior art.

Modern window assemblies in residential, commercial and industrial buildings may include one or more window sashes that are movable within a window jamb. Window sashes that move vertically to open and close often include two or more window balance assemblies. The balance assemblies urge the window sash upward (i.e., toward an open position for a lower sash or toward a closed position for an upper sash) to assist a user in moving the window sash and to retain the window sash at a position selected by the user.

A window sash may include pivot bars that allow the window sash to be removably attached to the window balance assemblies and to tilt relative to a window jamb, such as for cleaning and installation and removal of the sash.

SUMMARY

This section provides a general summary of the disclosure, and is not a comprehensive disclosure of its full scope or all of its features.

In one form, the present disclosure provides a window balance assembly for installation in a window assembly. The window balance assembly may include a carrier, a curl spring, and a mounting bracket. The curl spring has a curled portion and an end portion, with the curled portion being contained by the carrier. The mounting bracket engages an end portion of the spring and engages the carrier in an uninstalled configuration.

The carrier includes a first housing, a second housing, and a receiver. The first and second housings cooperate to contain the curled portion of the curl spring. The first housing has an exterior side, an interior side, a top end, a bottom end, and an aperture disposed proximate to the bottom end. The receiver is rotatably disposed in the aperture. The interior side includes a plurality of recesses formed concentric with, and partially surrounding, the aperture.

The receiver includes a generally U-shaped slot operable to receive a pivot bar of a window sash. The U-shaped slot extends inward from a front face of the receiver to a back wall. The receiver also includes cams located on opposite sides of the U-shaped slot. The cams are positioned in the recesses when the receiver is in a first orientation in the carrier where the U-shaped slot opens vertically upwardly.

When the receiver is in a second orientation where the U-shaped slot opens horizontally, the cams are adjacent to the recesses.

The first housing also includes a channel that is formed in the exterior side. The channel is open to the aperture and has a back wall. The back wall of the channel is generally even with the back wall of the receiver at the location of the aperture. The channel extends vertically upwardly from the aperture toward the top end of the first housing. The channel facilitates a "full-drop-in" installation and removal of the window sash in the window assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
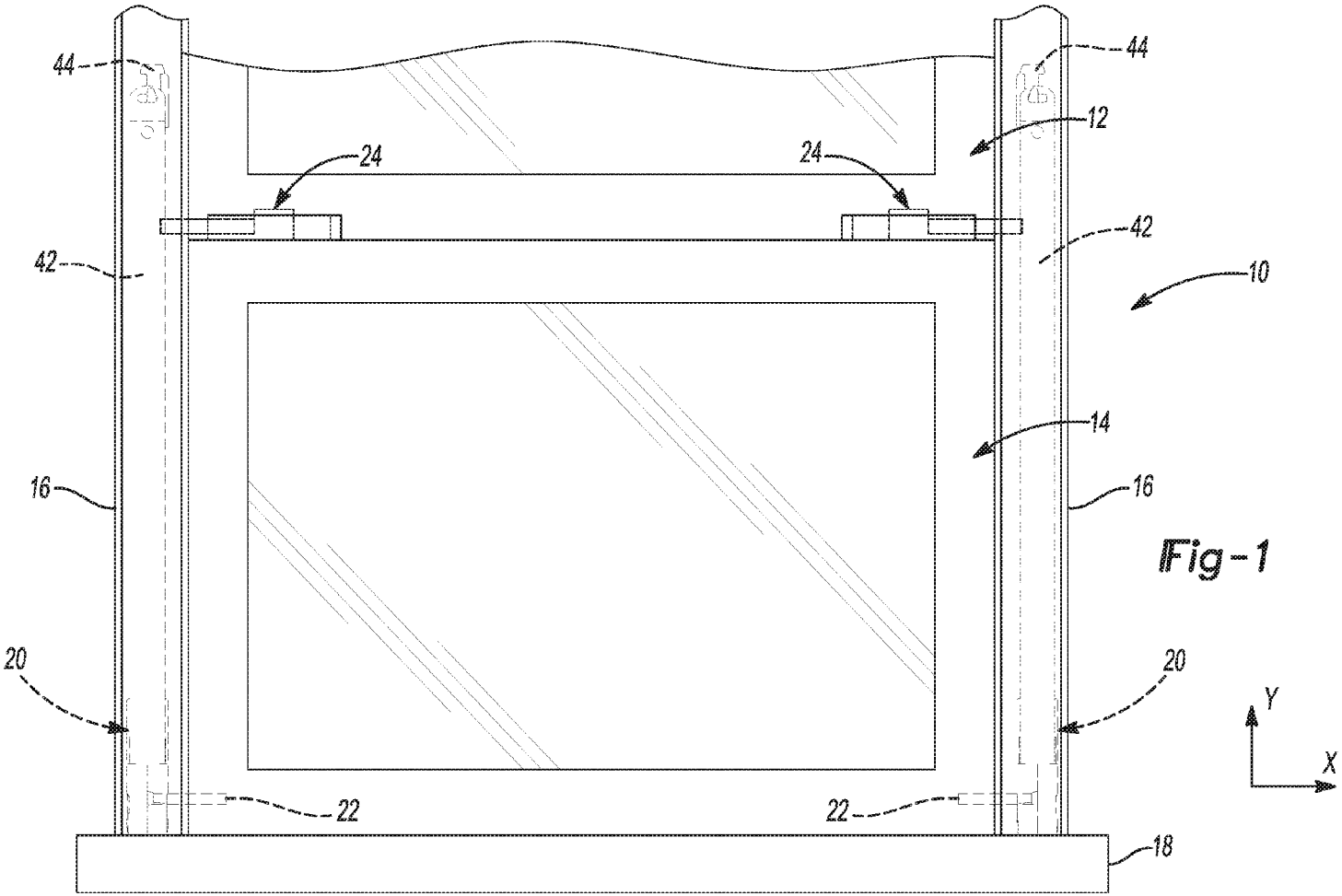
FIG. 1 is a partial schematic front view of a window assembly including window balance assemblies according to the principles of the present disclosure.
Figure 2:
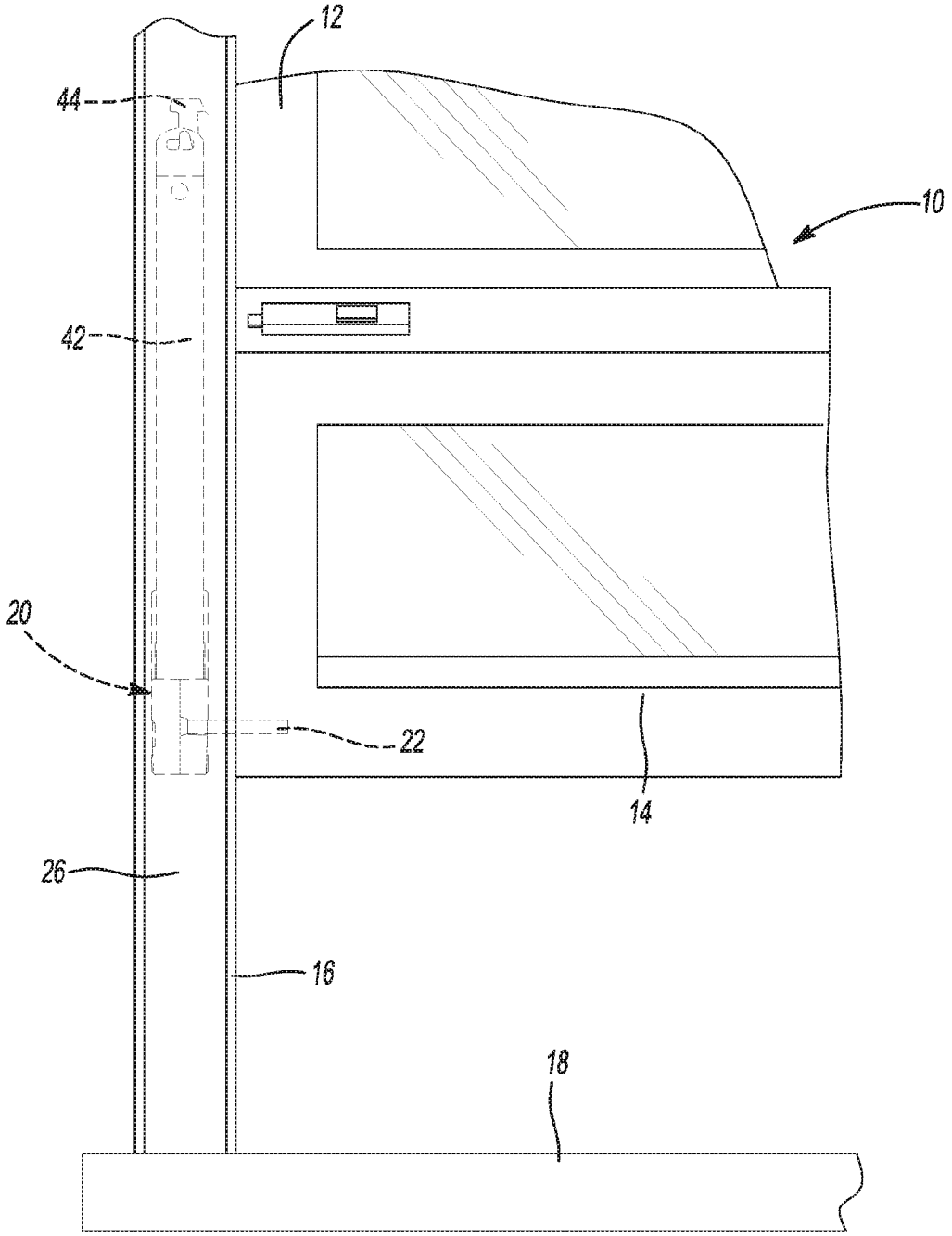
FIG. 2 is a partial schematic front view of the window assembly of FIG. 1 showing a raised and tilted window sash.
Figure 3:
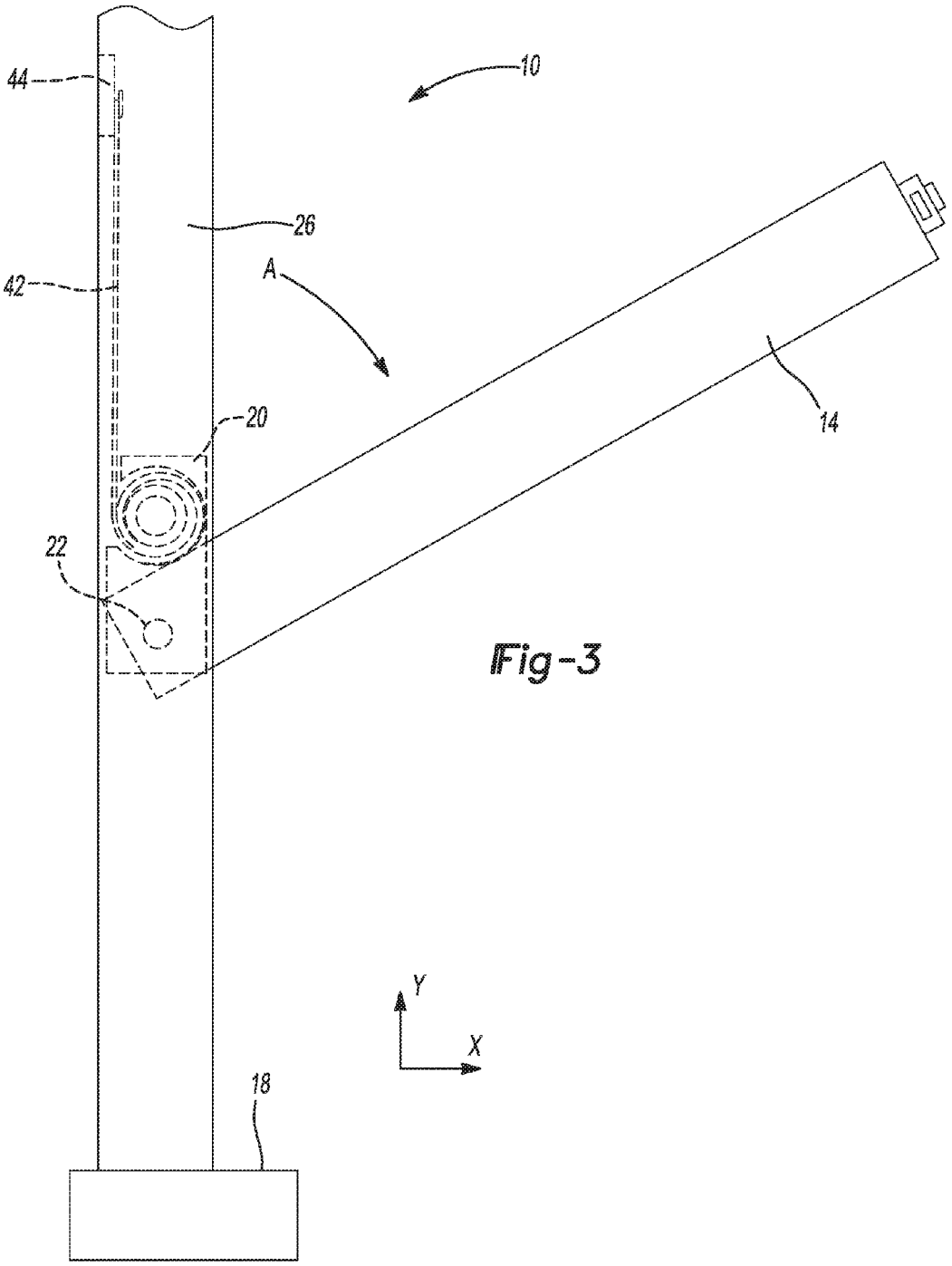
FIG. 3 is a partial schematic side view of the window assembly of FIG. 2.

With reference to FIGS. 1-3, a window assembly 10 is provided that may include an upper sash 12, a lower sash 14, a pair of window jambs 16, a window sill 18, and two or more window balance assemblies 20. In the particular embodiment illustrated, the upper sash 12 is fixed relative to the window sill 18 (i.e., in a single hung window assembly). However, in some embodiments, the upper sash 12 may be movable relative to the window sill 18 between a raised or closed position and a lowered or open position (i.e., in a double hung window assembly). The lower sash 14 may be raised and lowered between open and closed positions and may be connected to the window balance assemblies 20 which assist a user in opening the lower sash 14 and maintain the lower sash 14 in a desired position relative to the window sill 18.

The lower sash 14 may include a pair of pivot bars 22 and a pair of tilt latch mechanisms 24. The pivot bars 22 may extend laterally outward in opposing directions from a lower portion of the lower sash 14 and may engage corresponding ones of the window balance assemblies 20, as will be subsequently described. The tilt latch mechanisms 24 may extend laterally outward in opposing directions from an upper portion of the lower sash 14 and may selectively engage corresponding ones of the window jambs 16. As shown in FIGS. 2 and 3, the tilt latch mechanisms 24 may be selectively actuated to allow the lower sash 12 to pivot about the pivot bars 22 relative to the window jambs 16 to facilitate cleaning of an exterior side of the window assembly 10 and to allow separation of the lower sash 12 from the window assembly 10, for example.

It will be appreciated that in a double hung window assembly, the upper sash 12 may also be connected to two or more window balance assemblies to assist the user in opening the upper sash 12 and maintaining the upper sash 12 in a selected position relative to the window sill 18. In such a window assembly, the upper sash 12 may also include tilt latches and pivot bars to allow the upper sash 12 to pivot relative to the window jambs 16 in the manner described above.

Figure 12:
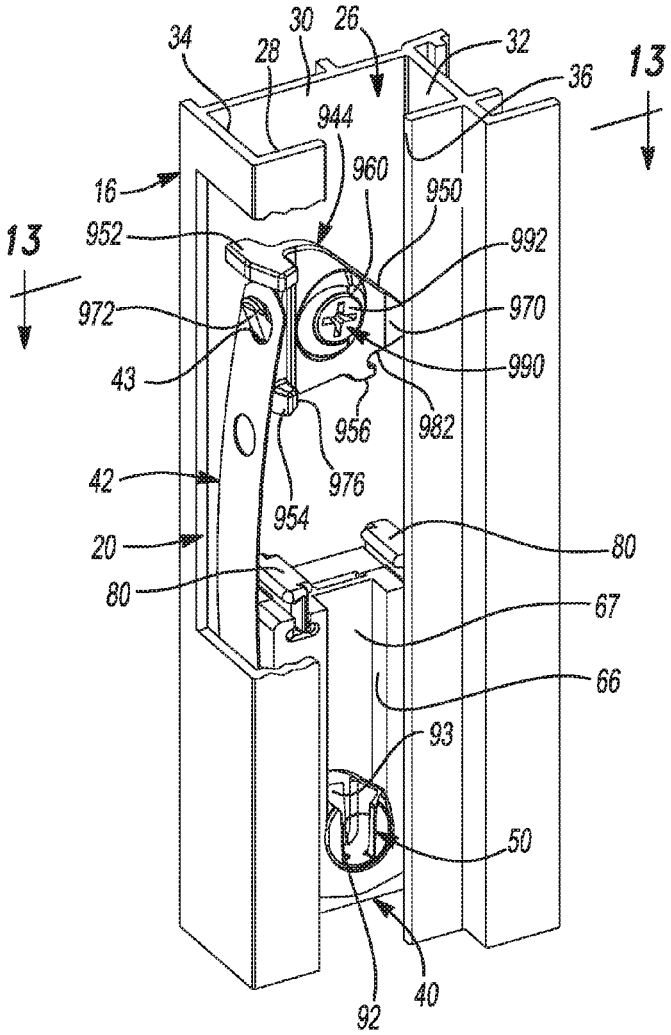
FIG. 12 is a partially cutaway perspective view of the window balance assembly of FIG. 4 installed in a window jamb.
Figure 13:
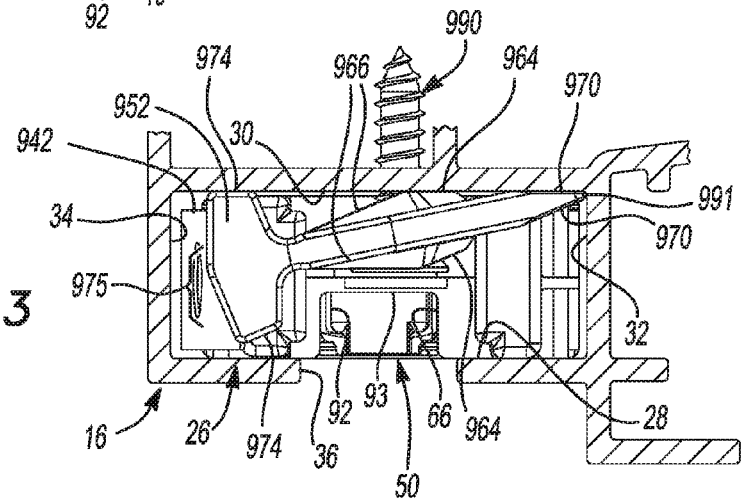
FIG. 13 is a cross-sectional view of the window balance assembly and window jamb taken along line 13-13 of FIG. 12.

Each of the window jambs 16 may include a jamb channel 26 defined by a first wall 28, a second wall 30 opposite the first wall 28, and third and fourth walls 32, 34 disposed perpendicular to the first and second walls 28, 30, as best seen in FIGS. 12 and 13. The first wall 28 may include a vertically extending slot 36 adjacent the lower sash 14. The window balance assembly 20 may be installed within the jamb channel 26. The pivot bar 22 may extend through the slot 36 and into the jamb channel 26 to engage the window balance assembly 20. The tilt latch mechanism 24 may also selectively engage the slot 36 to lock the lower sash 14 in an upright position as shown in FIG. 1.

Figure 5:
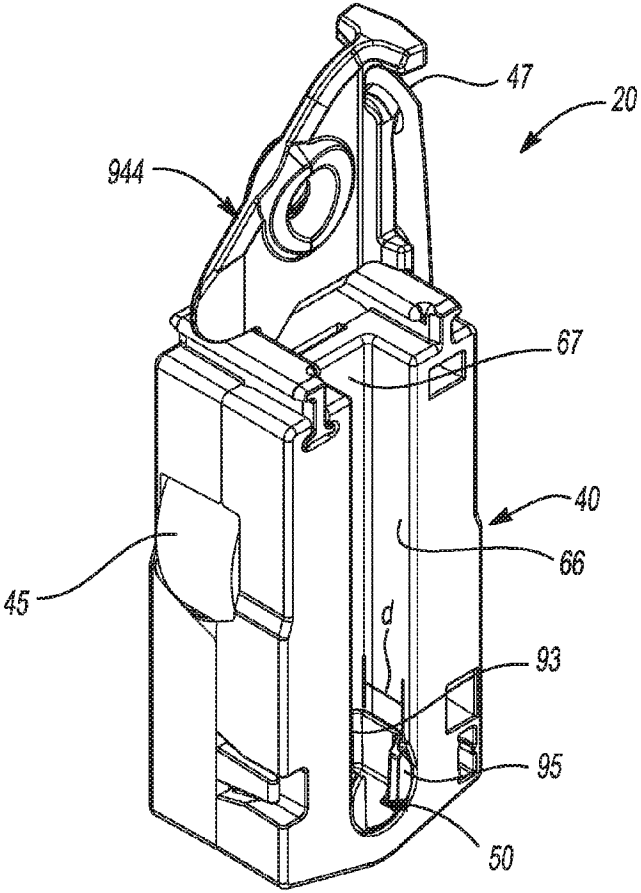
FIG. 5 is a left-front perspective view of the exemplary window balance assembly of FIG. 4.
Figure 4:
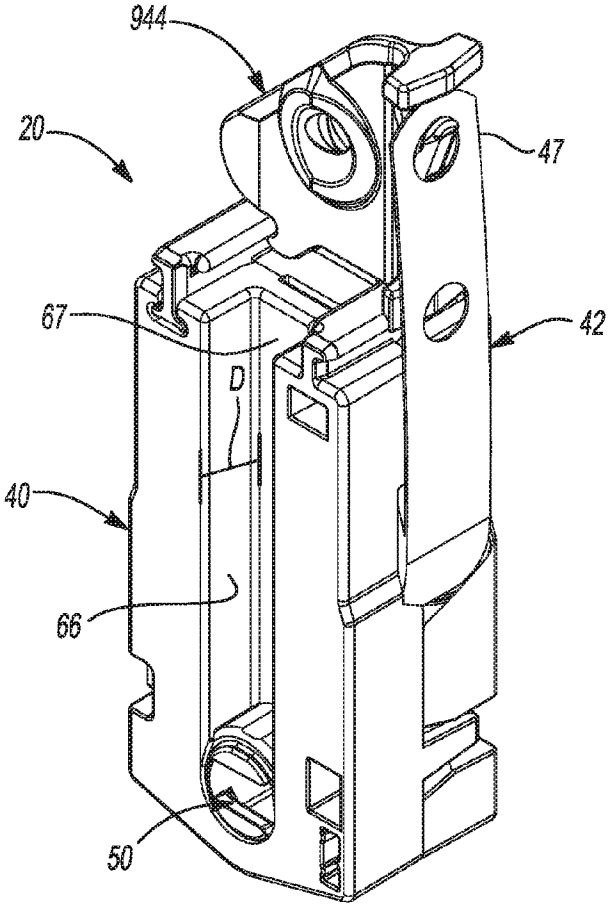
FIG. 4 is a right-front perspective view of an exemplary window balance assembly in an uninstalled configuration according to the principles of the present disclosure.
Figure 6:
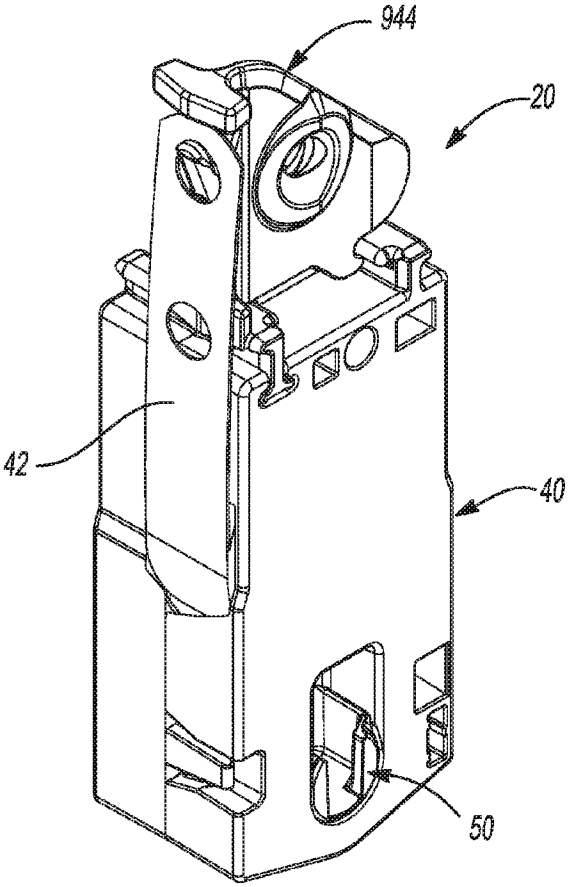
FIG. 6 is a right-rear perspective view of the exemplary window balance assembly of FIG. 4.

Each of the window balance assemblies 20 may include a carrier 40, a curl spring 42, and a mounting bracket 944. The window balance assemblies 20 may be initially assembled and shipped in an uninstalled or shipping configuration, as shown in FIGS. 4-6, and may be subsequently installed onto the window assembly 10 and placed in an installed configuration, as shown in FIGS. 12 and 13, by a window manufacturer, a construction or renovation contractor, or a homeowner, for example.

Figure 11A:
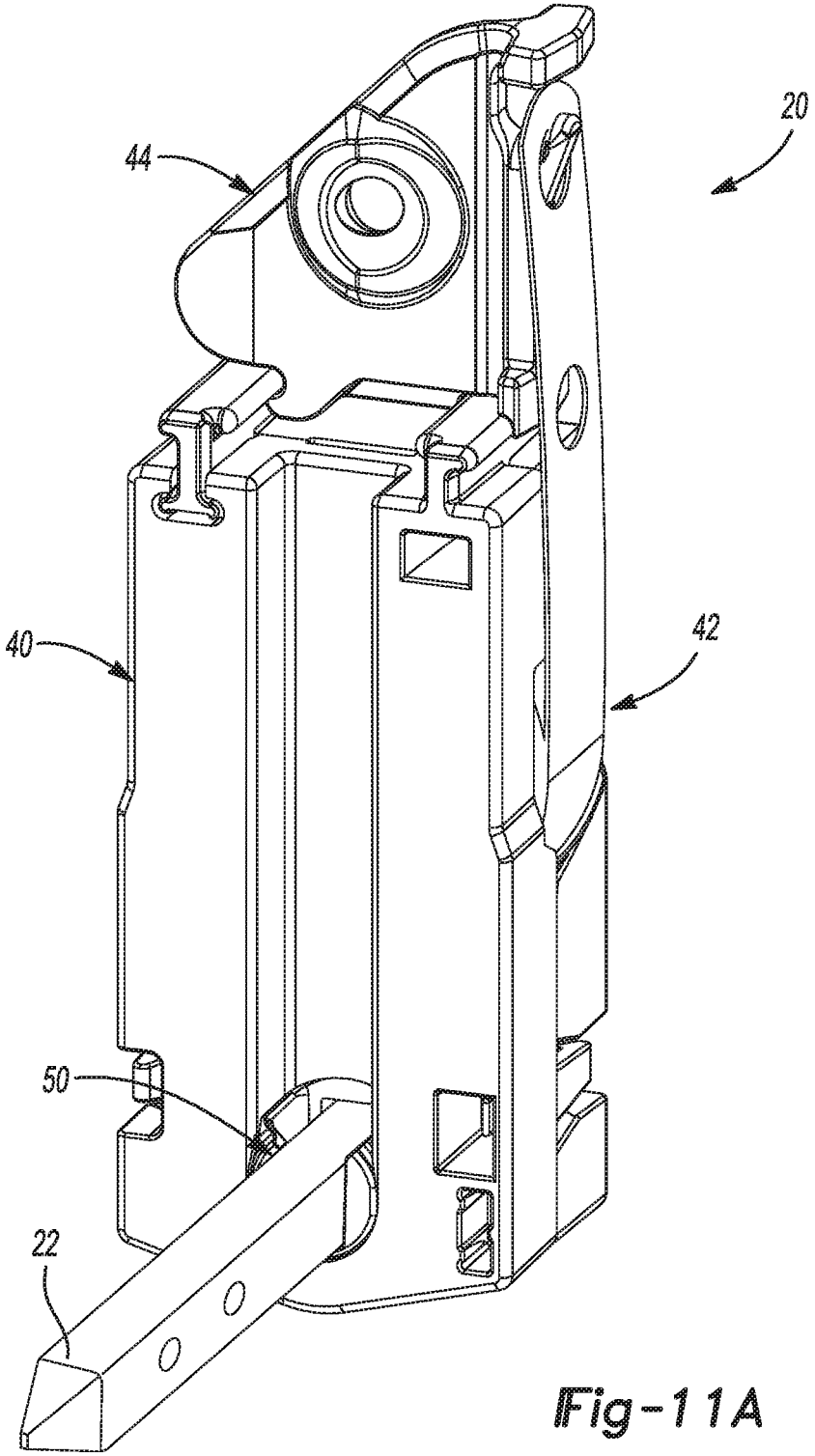
FIGS. 11A, 11B and 11C are perspective, right side and left side views, respectively, showing the interior of the exemplary window balance assembly of FIG. 4 and including a pivot bar engaged with the window balance assembly.
Figure 11B:
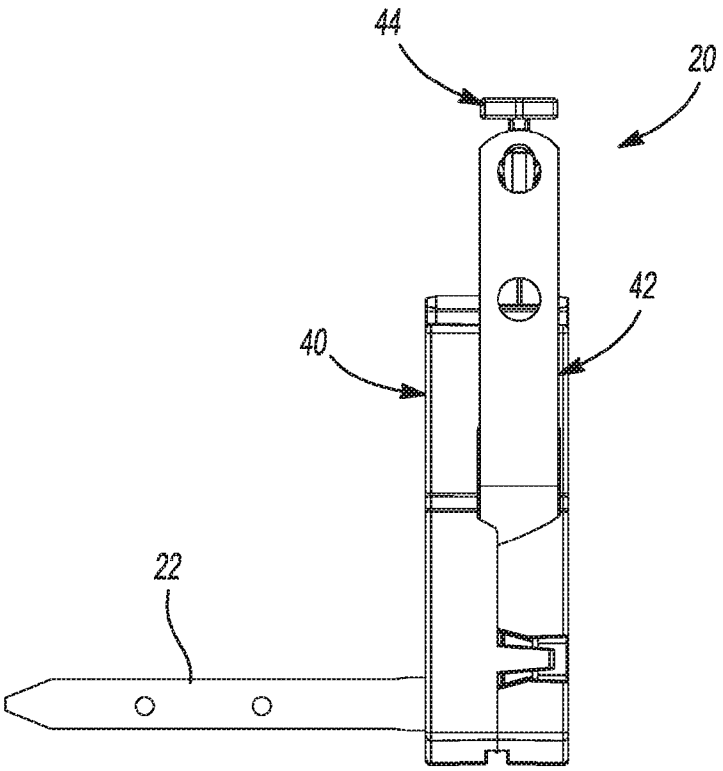
Figure 11C:
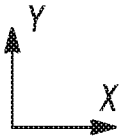
Figure 11C:
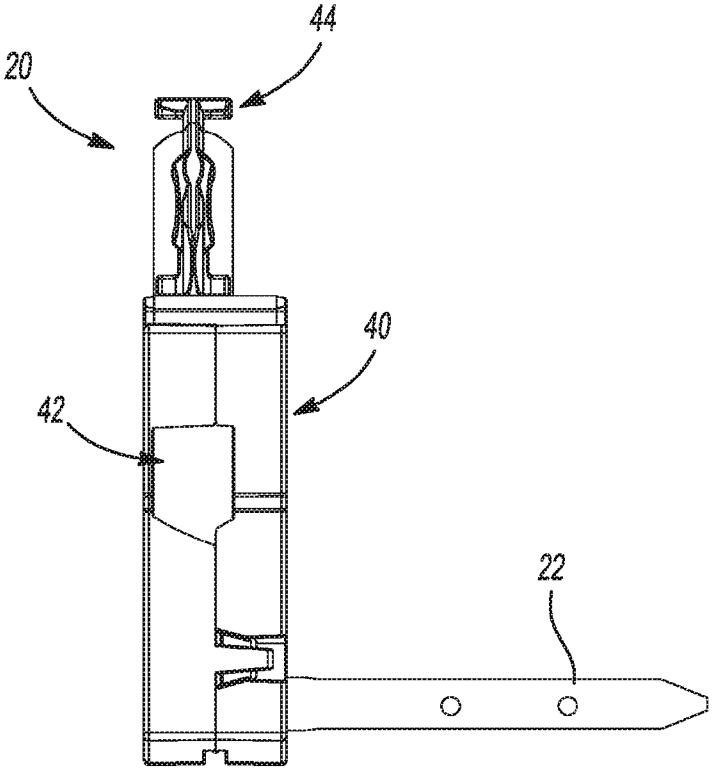

As schematically illustrated in FIGS. 1-3, the carrier 40 (also referred to as a shoe) may engage the lower sash 14 via the pivot bar 22 (which is best illustrated in FIGS. 11A-11C) and house a curled portion 45 of the curl spring 42. The carrier 20 is movable vertically within the jamb channel 26. The mounting bracket 944 may be fixed relative to the window jamb 16, as shown in FIGS. 12 and 13, and may engage an uncurled end portion 47 of the curl spring 42. The curl spring 42 may resist being uncurled such that the curl spring 42 exerts an upward force on the carrier 40, thereby biasing the lower sash 14 toward the open position.

Referring to FIGS. 12 and 13, the window balance assembly 20 is shown installed in a window jamb 16 with the mounting bracket 944 affixed to a the second wall 30 of the jamb channel 26. The mounting bracket 944 may be formed from a polymeric material, for example, and may include a body portion 950, a head 952, a base 954, and a tab 956. The mounting bracket 944 may be substantially symmetric about a plane defining the body portion 950 and extending through the head 952, base 954, and tab 956. The structure and function of the base 954 and the tab 956 simplify assembly of the mounting bracket 944 to the carrier 40 (i.e., assembly into the shipping configuration).

The body portion 950 may include a pair of bosses 960 disposed on opposite sides of the body portion 950. A mounting aperture 962 may extend through both of the bosses 960. Each of the bosses 960 may include countersink surfaces 961 surrounding the bosses 960 and first and second surfaces 964, 966 surrounding the countersink surfaces 961. The first and second surfaces 964, 966 may be disposed at non-perpendicular angles relative to each other and relative to exterior sides of the carrier 40 when the window balance assembly 20 is in the shipping configuration. The body portion 950 may also include a pair of tapered surfaces 970. Each tapered surface 970 may be substantially coplanar with the first surface 964 on the corresponding side of the body portion 950 (see FIG. 13).

A latch 972 may extend generally upward and outward from the body portion 950 between the head 952 and the base 954. The latch 972 may engage an aperture 43 in the curl spring 42. The latch 972 may include a lip 973 and may be in relatively close proximity to the head 952 to prevent or reduce inadvertent disengagement between the curl spring 942 and the latch 972.

The head 952 may extend laterally outward from the body portion 950 and may include a pair of third surfaces 974 and a pair of fourth surfaces 975. Each of the third surfaces 974 may be substantially coplanar with the first surface 964 and tapered surface 970 on the corresponding side of the body portion 950. One of the third surfaces 974 may abut the second wall 30 of the jamb channel 26 while the mounting bracket 944 is being fastened to thereto and when the window balance assembly 20 is in the installed configuration, as shown in FIG. 13. Each of the fourth surfaces 975 may be substantially perpendicular to an adjacent one of the third surfaces 974.

The base 954 may extend laterally outward from the body portion 950 and may include a pair of fifth surfaces 976 and a leg portion 978 (FIG. 21). Each of the fifth surfaces 976 may be on laterally opposite ends of the base 954 and may be substantially coplanar with the first surface 964, third surface 974 and tapered surface 970 on the corresponding side of the body portion 950. The leg portion 978 may cooperate with a first lower surface 979 of the body portion 950 to form a recess receiving one of the projections 80 of the carrier 40. The lateral span of the base 954 that engages the projection 80 provides increased stability of the mounting bracket 944 relative to the carrier 40 in the shipping configuration. This stability may prevent or reduce inadvertent disengagement of the mounting bracket 944 from the carrier 40 prior to installation of the window balance assembly 20 into the window assembly 10.

The mounting bracket 944 may be symmetric in that it includes each of the first surface 964, tapered surface 970, third surface 974 and the fifth surface 976 on each side of the mounting bracket 944. This symmetry allows the mounting bracket 944 to be universal, in that it can be installed in window jambs on both the left and right sides of the sashes 12, 14. This feature further reduces the total number of unique components and subassemblies that may be required for an installation of a single window assembly.

The tab 956 may extend from a second lower surface 982 and may cooperate with the second lower surface 982 to engage at least a portion of the other of the projections 80. In some embodiments, the tab 956 may slidably engage the projection 80. In some embodiments, the tab 956 may snap into and out of engage with the projection 80 or breakaway from the projection 80.

Referring to FIGS. 8, 9, 10A and 10B, the carrier 40 may include a first housing portion 46, a second housing portion 48, and a receiver 50. The first and second housing portions 46, 48 fit together to form a housing for the curl spring 42 and the receiver 50. Each of the first and second housing portions 46, 48 may include an exterior side 52, 53, an interior side 54, 55, a top end 56, a bottom end 58, a first side 60, and a second side 62. An aperture 64 disposed proximate the bottom end 58 may extend through the exterior and interior sides 52, 53, 54, 55 and may rotatably engage the receiver 50. Arcuate recesses 65 formed in the interior sides 54, 55 may be concentric with the aperture 64 and may partially surround the aperture 64.

A channel 66 is formed in the exterior side 52 of the first housing portion 46. The channel 66 has a back wall 67 that is located at a distance D from the exterior side 52. The back wall 67 is generally parallel to the exterior side 52, however, in another configuration, the back wall 67 could be slightly inclined, either toward the exterior side 52, or away from the exterior side 52. The channel 66 extends generally vertically upwardly in the exterior side 52. At a lower end, the channel 66 is in open communication with the aperture 64. As shown, the channel 66 extends vertically upwardly from the aperture 64 and extends through the top end 56 of the first housing portion 46 of the carrier 40. Alternatively, however, in another configuration the channel 66 can extend vertically upward from the aperture 64 and terminate before the top end 56 of the first housing portion 46 of the carrier 40. As configured, the channel 66 facilitates the easy "full-drop-in" installation and removal of the window sash, e.g., the lower sash 14, from the window balance assembly as is further described herein.

A barbed protuberance 68 may be disposed at or proximate to the first side 60 and may extend outward from the interior side 54. A slot 70 may be formed in the second side 62 generally opposite the barbed protuberance 68 such that when the first and second housing portions 46, 48 are assembled together, the barbed protuberances 68 may engage the second slots 70, which is shown best in FIGS. 4-7. The length of the barbed protuberance 68 may be sufficient to allow the first and second housing portions 46, 48 to move relative to each other between a first position (FIGS. 4 and 7) and a second position (FIGS. 5, 6, 11A and 11B) without disengaging each other.

Figure 8:
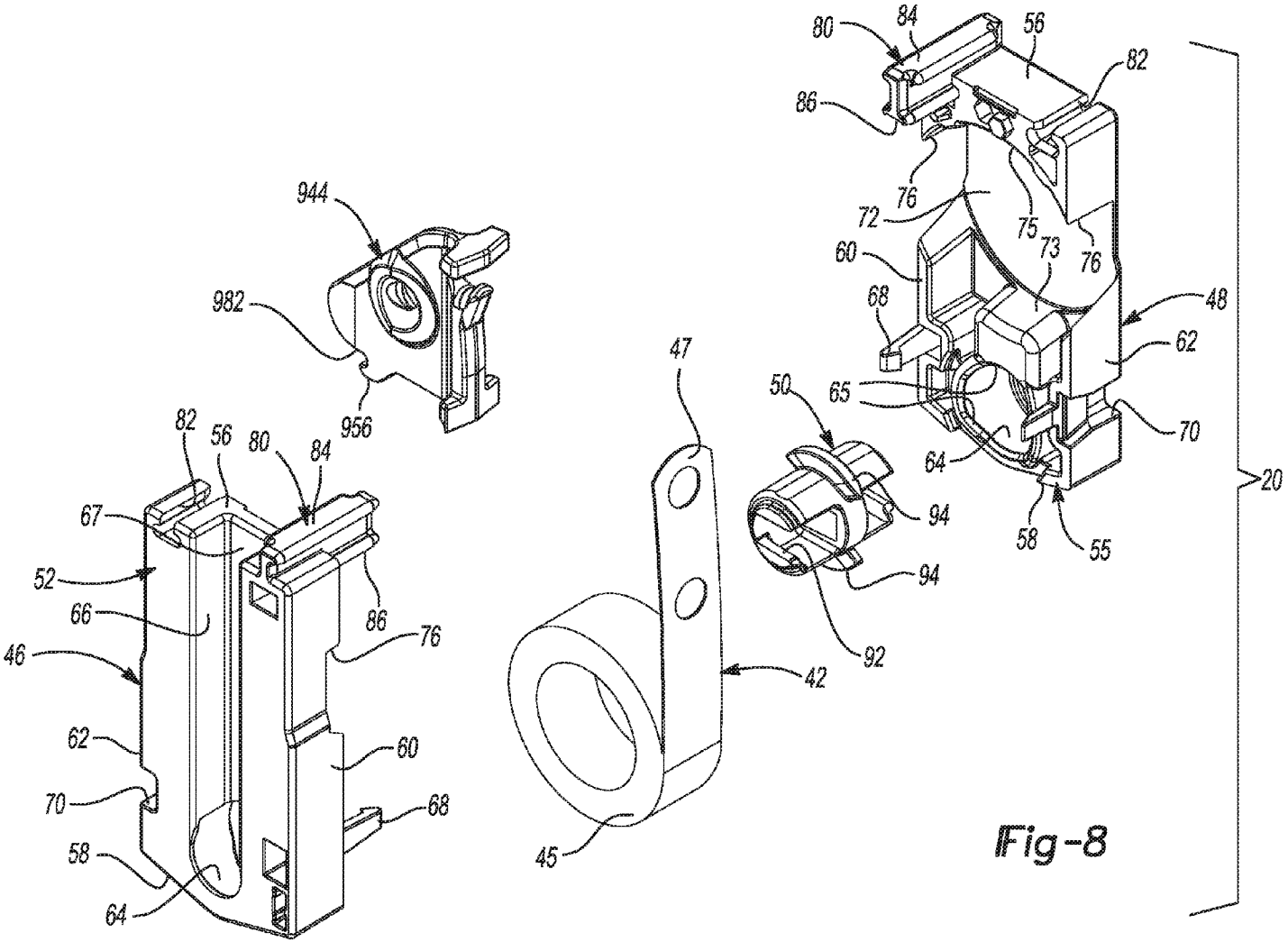
FIG. 8 is a front exploded perspective view of the exemplary window balance assembly of FIG. 4.
Figure 9:
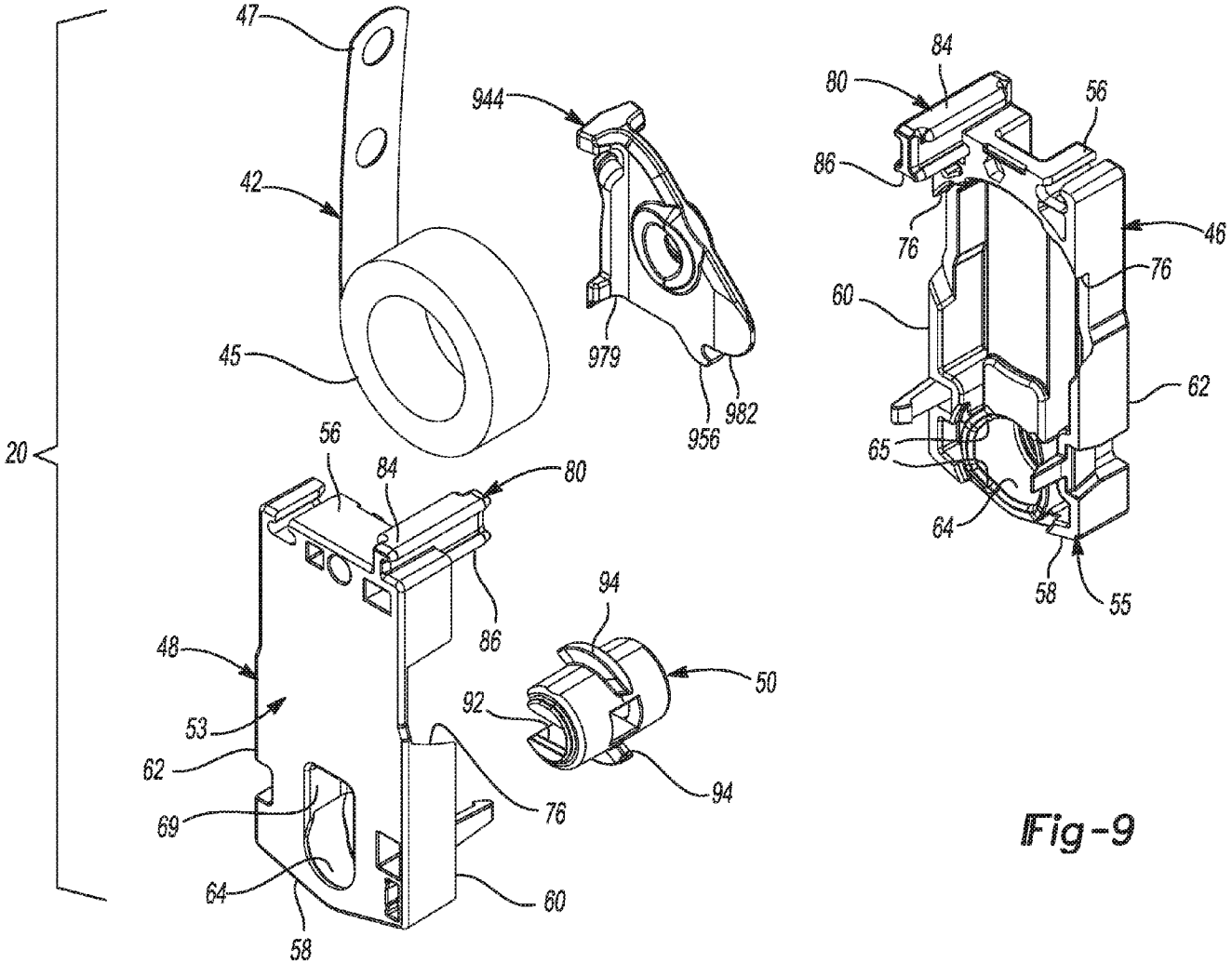
FIG. 9 is a rear exploded perspective view of the exemplary window balance assembly of FIG. 4.

Also shown in FIGS. 8 and 9, the exterior side 53 of the second housing portion 48 includes a slot 69 located at an upper end of the aperture 64 that is in communication with the aperture 64. As best seen in FIG. 8, an upper wall 73 the slot 69 extends into the interior side 55 of the second housing portion 48.

The interior side 55 of the second housing portion 48 may include a generally cylindrical recess 72 that is bounded by an arcuate surface 75 at an upper end and the upper wall 73 of the slot 69 at a lower end. When the first and second housing portions 46, 48 are assembled together, the cylindrical recess 72 is bounded by the interior sides 54, 55 of the first and second housing portions 46, 48 and forms an enclosed space that receives the curled portion 45 of the curl spring 42. Openings 76 in communication with the recess 72 may be formed in the first and second ends 60, 62 through which the uncurled portion 47 of the curl spring 42 may extend toward the mounting bracket 944.

The first and second housing portions 46, 48 may also include projections 80 and second slots 82 disposed at the top end 56. The projections 80 may extend from the exterior sides 52, 53 beyond the interior sides 54, 55 and may include a generally I-shaped cross-section having upper and lower flanges 84, 86. The second slots 82 may be sized and shaped to enable the second slots 82 of the first housing portion 46 and the second housing portion 48 to slidably engage the lower flanges 86 of the second housing portion 48 and the first housing portion 46, respectively.

Figure 10B:
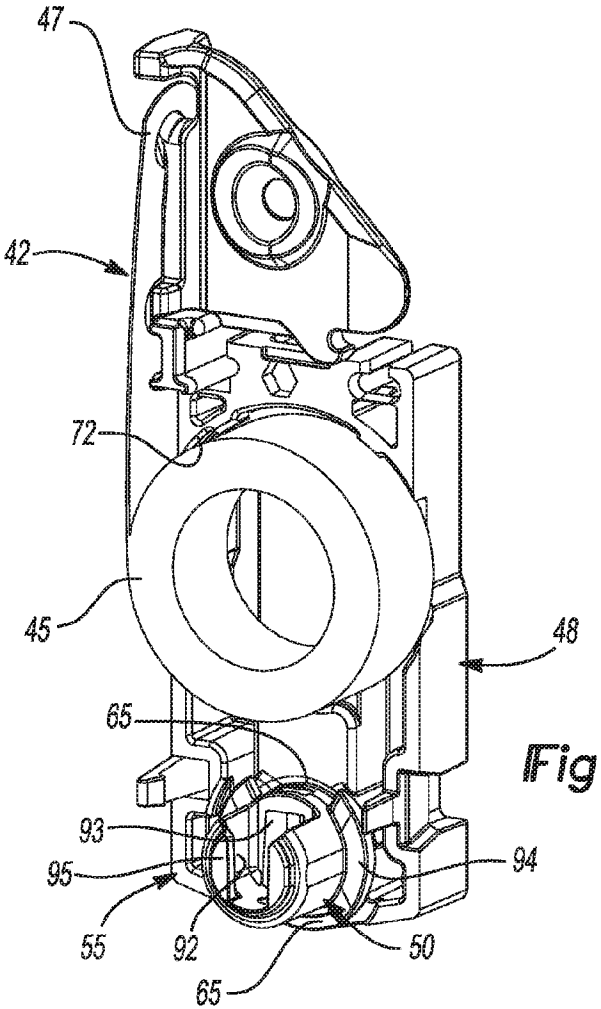
FIGS. 10A and 10B are perspective views showing the interior of the housing of the exemplary window balance assembly of FIG. 4.
Figure 10A:
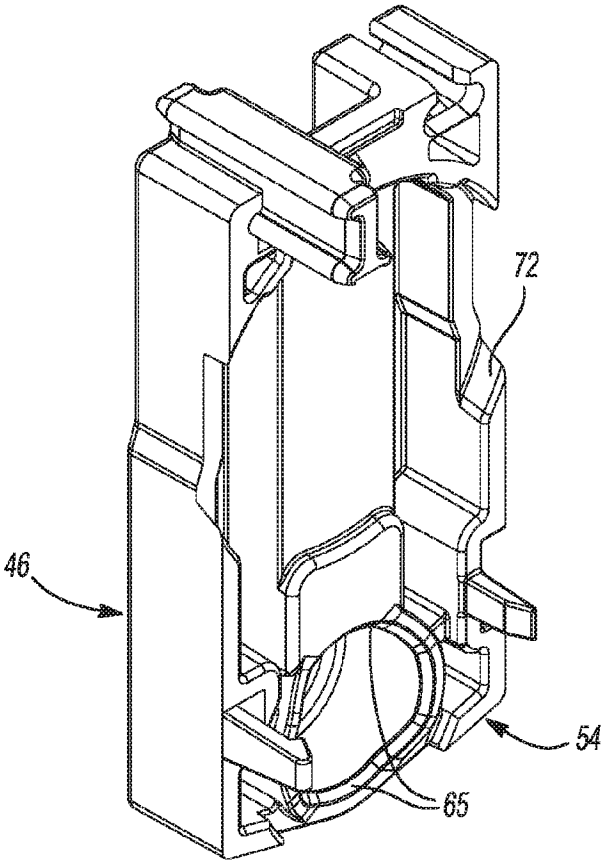

The receiver 50 may be a generally cylindrical member and include a U-shaped slotted recess 92 formed in one end thereof (although the carrier 50 is shown to include two recesses 92, one at each opposite end of the carrier 50, this is merely to eliminate the need to orient the receiver 50 during the installation and simplify that process). The receiver 50 is located in the carrier 40 so that the recess 92 is adjacent to the exterior side 52 of the first housing portion 46. In addition, the slotted recess 92 has back wall 93 which is located at a distance d from a front surface 95 of the carrier, as best illustrated in FIGS. 5 and 10B. As positioned in the carrier 40, the back wall 93 of the receiver 50 is generally even with the back wall 67 of the channel 66 at the aperture 64. Annular cams 94 extend around a portion of the perimeter of the receiver 50. The recess 92 of each of the window balance assemblies 20 may receive a corresponding one of the pivot bars 22 extending from the lower sash 14. As seen in FIGS. 11A, 11B and 11C, the pivot bar 22 extends into the recess 92.

As described above, the receiver 50 may be rotatable within the aperture 64 to allow the lower sash 14 to pivot about the pivot bar 22 between an upright position and a tilted position, as shown in FIGS. 2 and 3. The angular spans of the cams 94 may correspond to the angular spans of the arcuate recesses 65 that partially surround the aperture 64 in the first and second housing portions 46, 48 such that when the lower sash 14 is in the upright position, the cams 94 fit within the arcuate recesses 65.

Figure 7:
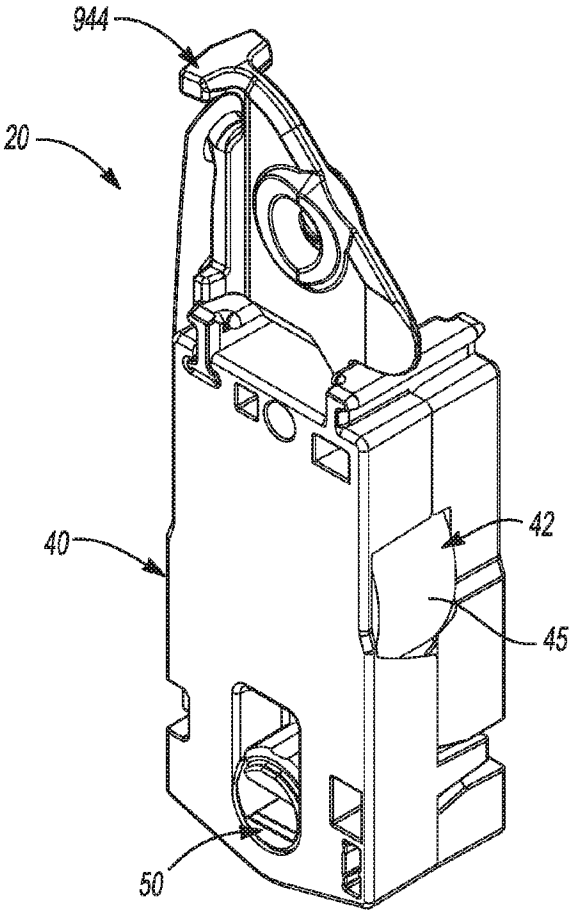
FIG. 7 is a left-rear perspective view of the exemplary window balance assembly of FIG. 4.

When the receiver 50 is rotated such that the U-shaped slotted recess 92 is oriented horizontally in the carrier 40, the cam 94 may be fully received within the arcuate recess 65. When the cam 94 is received in the arcuate recess 65, the first and second housing portions 46, 48 are allowed to fully close together, as shown in FIGS. 4 and 7. In this configuration, the carrier 40 is in an unlocked or unrestricted position, such that the carrier 40 may be generally unrestricted from moving upward and downward in the window jamb 16 as the lower sash 14 moves between the open and closed positions.

When the lower sash 14 is tilted relative to the window jamb 16 in the direction of arrow A shown in FIG. 3, the pivot bar 22 rotates the receiver 50 toward the orientation shown in FIGS. 5 and 6. Rotating the receiver 50 in this manner moves the cams 94 out of the arcuate recesses 65 and causes the cams 94 to force the interior sides 54, 55 of the first and second housing portions 46, 48 away from each other. In this manner, the exterior sides 52, 53 of the first and second housing portions 46, 48 are forced against the first and second walls 28, 30 of the jamb channel 26, as shown in FIGS. 12 and 13. Forcing the exterior sides 52, 53 outward against the first and second walls 28, 30 creates friction that may be sufficient to lock the carrier 40 in place relative to the jamb channel 26. Accordingly, when the lower sash 14 is in a tilted position, the window balance assembly 20 may be prevented from exerting a net upward force on the lower sash 14. After the carrier 40 is locked in place within the jamb channel 26, the lower sash 14 can be easily removed from the window assembly 10 for maintenance or replacement, for example.

At about 90 degrees of rotation in the direction of arrow A, the lower sash 14 is generally oriented horizontally. In this configuration, the carrier is locked and the slotted recess 92 of the receiver 50 is oriented vertically upwardly and is generally aligned with the channel 66 in the exterior side 52 of the first housing 46 of the carrier 40, as shown, e.g., in FIGS. 5, 6 and 11A and 12. At this point, the lower sash 14 can be removed from the window assembly 10. First, the lower sash is moved or lifted vertically upwardly so that the pivot bars 22 move out of the slotted recesses 92 in the receivers 50 and into the channels 66 in the carriers 40. The lower sash 14 is continued to move vertically upwardly so that the pivot bars 22 move vertically through the channels 66 until the pivot bars 22 become disengaged from the window balance assemblies 20. Thereafter, the lower sash 14 can be maneuvered (e.g., by slight tilting) such that the pivot bars 22 pass through the slots 36 in the jamb channel 26 and the lower sash 14 can be removed from the window assembly 10.

The procedure may be employed in reverse to install the lower sash 14 into the window assembly 10. That is, with the lower sash 14 tilted relative to the upper sash 12, the lower sash 14 may be rotated so that the pivot bars 22 can be alternatingly maneuvered through the slots 36 in the jamb channel 26. Once that is accomplished, the lower sash 14 can be positioned horizontally. The lower sash 14 can be moved vertically downwardly so that the pivot bars 22 simultaneously engage the window balance assemblies 20 by entering the channels 66 in the respective carriers 40. With both pivot bars 22 engaged with the respective carriers 40, the pivot bars 22 can then be vertically lowered into engagement with the slotted recesses 92 in the receivers 50. Thereafter, the lower sash 14 may be pivoted to the upright position relative to the upper sash 12 (e.g., in an opposite direction to arrow A of FIG. 3), which causes the receivers 50 to rotate to the position shown in FIGS. 4 and 7. As described above, rotating the receivers 50 to the position shown in FIGS. 4 and 7 allows the first and second housing portions 46, 48 of the carriers 40 to close together, thereby reducing or eliminating friction between the carriers 40 and the jamb channels 26 to allow unrestricted movement of the carriers 40 therein.

The configuration of the window balance assembly 20 of the present disclosure, therefore, simplifies the installation and removal of the window sash in a window assembly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A window balance assembly for installation in a window assembly comprising a moveable window sash having a pivot bar for engaging the window balance assembly, the window balance assembly comprising:

a carrier;

a curl spring having a curled portion and an end portion, the curled portion being contained by the carrier;

a mounting bracket engaging the end portion of the curl spring and selectively engaging the carrier, the mounting bracket engaging the carrier in an uninstalled configuration; and wherein the carrier comprises a first housing portion, a second housing portion, and a receiver;

the first housing portion comprising an exterior side, an interior side, a top end, a bottom end, and an aperture disposed proximate to the bottom end, the receiver being rotatably disposed within the aperture;

wherein a plurality of recesses are formed in the interior side concentric with and partially surrounding the aperture;

wherein the receiver comprises a generally U-shaped slot operable to receive the pivot bar of the window sash, the U-shaped slot having a first back wall;

wherein the receiver comprises first and second cams located on opposite sides of the U-shaped slot, the first and second cams being located in the recesses when the receiver is in a first orientation wherein the U-shaped slot opens vertically upwardly and being adjacent to the recesses when the receiver is in a second orientation wherein the U-shaped slot opens horizontally;

wherein the exterior side of the first housing portion comprises a channel in communication with the aperture and having a second back wall, the second back wall being substantially coplanar with the first back wall at the aperture;

wherein the channel extends vertically upwardly from the aperture toward the top end of the first housing portion and is operable to facilitate a full-drop-in installation and removal of the window sash in the window assembly.

2. The window balance assembly of claim 1 wherein the channel extends through the top end of the first housing portion.

3. The window balance assembly of claim 2 wherein an exterior side of the second housing portion comprises a slot located at an upper end of the aperture in communication with the aperture.

4. The window balance assembly of claim 3 wherein an upper wall of the slot extends into an interior side of the second housing portion; and wherein the interior side of the second housing portion includes a generally cylindrical recess that is bounded by an arcuate surface at an upper end and the upper wall of the slot at a lower end.

5. The window balance assembly of claim 4 wherein the interior side of the second housing portion comprises a recess forming an enclosed space bounded by the interior side of the first housing portion that is operable to contain the curled portion of the curl spring.

6. The window balance assembly of claim 1 wherein an exterior side of the second housing portion comprises a slot located at an upper end of the aperture in communication with the aperture.

7. The window balance assembly of claim 6 wherein an upper wall of the slot extends into an interior side of the second housing portion; and wherein the interior side of the second housing portion includes a generally cylindrical recess that is bounded by an arcuate surface at an upper end and the upper wall of the slot at a lower end.

8. A window balance assembly comprising:

a carrier, a curl spring, and a mounting bracket;

the carrier comprising a first housing portion, a second housing portion, and a receiver;

the first and second housing portions comprising first and second exterior sides, first and second interior sides, first and second top ends, first and second bottom ends, and first and second apertures disposed, respectively, proximate to the first and second bottom ends, the receiver being rotatably disposed within the first and second apertures;

the second housing portion comprising a recess forming an enclosed space bounded by the first interior side of the first housing portion that is operable to contain a first portion of the curl spring;

the mounting bracket engaging a second portion of the curl spring and selectively engaging an upper end of the carrier in an uninstalled configuration;

the receiver comprising a generally U-shaped slot operable to receive a pivot bar of a window sash, the U-shaped slot having a first back wall;

the exterior side of the first housing portion comprising a channel in communication with the first aperture and extending vertically upwardly through the first top end of the first housing portion, the channel having a second back wall that is coplanar with the first back wall and two side walls that are generally parallel with the slot when the receiver is oriented vertically in the carrier; and wherein the channel is operable to facilitate a full-drop-in installation and removal of the pivot bar of the window sash.

9. The window balance assembly of claim 8 wherein the second exterior side of the second housing member comprises a slot located at an upper end of the second aperture in communication with the second aperture.

10. The window balance assembly of claim 9 wherein an upper wall of the slot extends into the second interior side of the second housing portion; and wherein the second interior side of the second housing portion includes a generally cylindrical recess that is bounded by an arcuate surface at an upper end and the upper wall of the slot at a lower end.

11. A window assembly comprising:

a first window jamb comprising a first jamb channel;

a second window jamb comprising a second jamb channel;

at least one moveable window sash disposed between the first and second window jambs, the at least one moveable window sash comprising first and second pivot bars, the first pivot bar extending laterally outwardly from a first side of the at least one moveable window sash in a first direction and the second pivot bar extending laterally outwardly from a second side of the at least one moveable window sash in a second direction, the first and second directions being opposite to one another;

a plurality of full-drop-in window balance assemblies, wherein at least one of the plurality of full-drop-in window balance assemblies is disposed in each of the first and second jamb channels, wherein at least two of the plurality of full-drop-in window balance assemblies are cooperable with the at least one moveable window sash, and wherein each of the plurality of full-drop-in window balance assemblies comprises:

a carrier comprising a first housing portion, a second housing portion, and a receiver, wherein the first housing portion comprises a first exterior side, a first interior side, a first top end, a first bottom end, and a first aperture disposed proximate to the first bottom end, wherein the second housing portion comprises a recess forming an enclosed space bounded by the first interior side of the first housing portion, wherein the receiver is rotatably disposed within the first aperture and comprises a generally U-shaped slot comprising first and second side walls and a first back wall, and wherein the U-shaped slot is operable to receive one of the first and second pivot bars;

a curl spring comprising a first portion and a second portion, the first portion of the curl spring being contained in the enclosed space; and a mounting bracket engaging the second portion of the curl spring and selectively engaging an upper end of the carrier in an uninstalled configuration;

wherein the exterior side of the first housing portion comprises a channel in communication with the first aperture and extending vertically upwardly through the first top end of the first housing portion, the channel having a second back wall that is coplanar with the first back wall and third and fourth side walls that are each generally parallel with the first and second side walls when the receiver is oriented vertically in the carrier.

12. The window assembly of claim 11, wherein the at least one moveable window sash comprises first and second moveable window sashes.

* * * * *